US005781999A

United States Patent [19]

Chang

[11] Patent Number: 5,781,999

[45] Date of Patent: Jul. 21, 1998

[54] THINNING SCISSORS

[76] Inventor: Meng Cheng Chang, P. O. Box 82-144, Taipei, Taiwan

[21] Appl. No.: 813,390

[22] Filed: Mar. 7, 1997

[51] Int. Cl.[6] ..... B26B 13/04; B26B 13/20

[52] U.S. Cl. ..... 30/260; 30/341; 30/232

[58] Field of Search ..... 30/195, 256, 260, 30/341, 232

[56] References Cited

U.S. PATENT DOCUMENTS

| | | | |
|---|---|---|---|
| 927,058 | 7/1909 | Krouse | 30/341 |
| 2,639,504 | 5/1953 | May | 30/260 |
| 3,906,630 | 9/1975 | Megna | 30/260 |
| 5,109,608 | 5/1992 | Pracht | 30/341 |

FOREIGN PATENT DOCUMENTS

| | | | |
|---|---|---|---|
| 3928859 | 3/1991 | Germany | 30/341 |
| 305071 | 1/1920 | United Kingdom | 30/341 |

*Primary Examiner*—Hwei-Siu Payer
*Attorney, Agent, or Firm*—A & J

[57] ABSTRACT

A thinning scissors includes two blade holders holding a respective cutting blade for cutting the hair, a fork member fixedly secured to one end of one blade holder for the resting of the thumb, and a finger ring revolvably coupled to one end of the other blade holder for receiving the ring finger for permitting the user to change the cutting angle conveniently.

4 Claims, 6 Drawing Sheets

THINNING SCISSORS

BACKGROUND OF THE INVENTION

1. Field of the Invention

This invention relates to a thinning scissors for hairdresser, and more particularly to such a thinning scissors which permits the user to change the cutting angle conveniently.

2. Description of the Prior Art

A regular thinning scissors for hairdresser is generally comprised of two blades pivoted together. Each blade has a cutting edge at the front side, and a circular or oval handle at the rear side. This structure of thinning scissors has drawbacks. Because the blades are respectively made in integrity, the circular or oval handle cannot be turned relative to the respective blade. When changing the cutting angle, the wrist must be relative turned, therefore the wrist aches quickly when cutting the hair. Furthermore, when to change a hairdressing instrument, it is inconvenient to release the thinning scissors from the hand.

SUMMARY OF THE INVENTION

This invention relates to an improved thinning scissors for hairdresser.

It is one object of the present invention to provide a thinning scissors which permits the user to change the cutting angle conveniently. It is another object of the present invention to provide a thinning scissors which can be conveniently released from the hand. To achieve these and other objects of the present invention, the thinning scissors comprises a first holder blade and a second holder blade pivoted together, the first holder blade having handle extended from a rear end thereof and defining a circular axial hole, the second holder blade having a handle extended from a rear end thereof and defining a square axial hole; a first cutting blade and a second cutting blade respectively fastened to the first holder blade and the second holder blade and moved against each other for cutting the hair; a finger ring mounted with a rubber ring on the inside and attached to the handle of the first holder blade for receiving the user's ring finger, the finger ring having a projecting shaft raised from the periphery and turned in the circular axial hole of the handle of the first holder blade; and a fork member attached to the handle of the second holder blade for moving the second holder blade relative to the first holder blade by the user's thumb, the fork member having a square coupling tip fitted into the square axial hole of the handle of the second holder blade.

DETAILED DESCRIPTION OF THE PREFERRED EMBODIMENT

Figure 1:
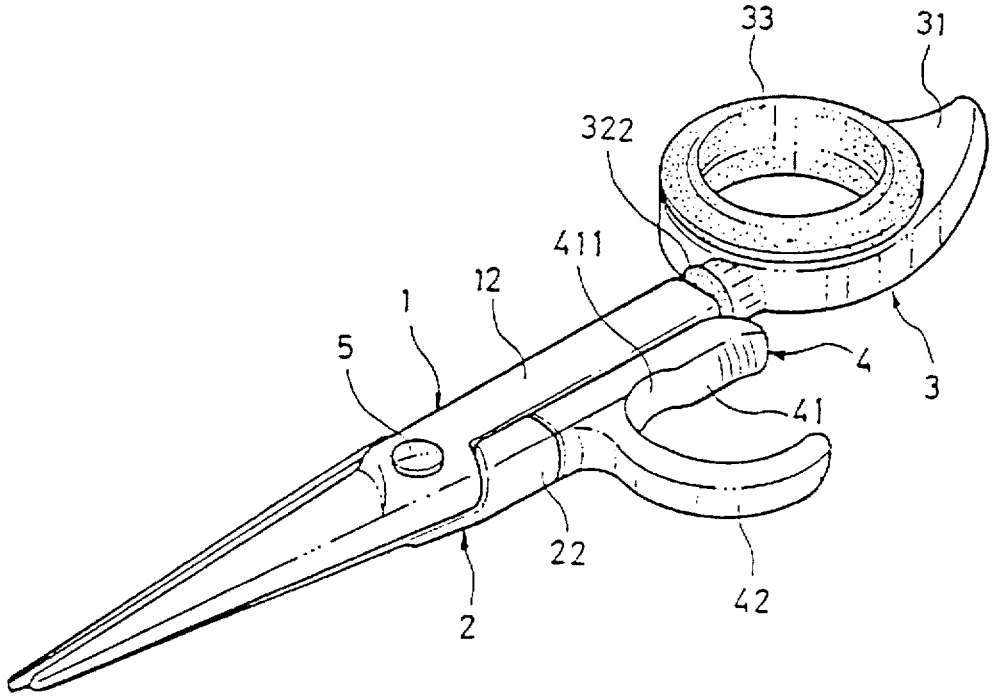
FIG. 1 is an elevational view of a thinning scissors according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
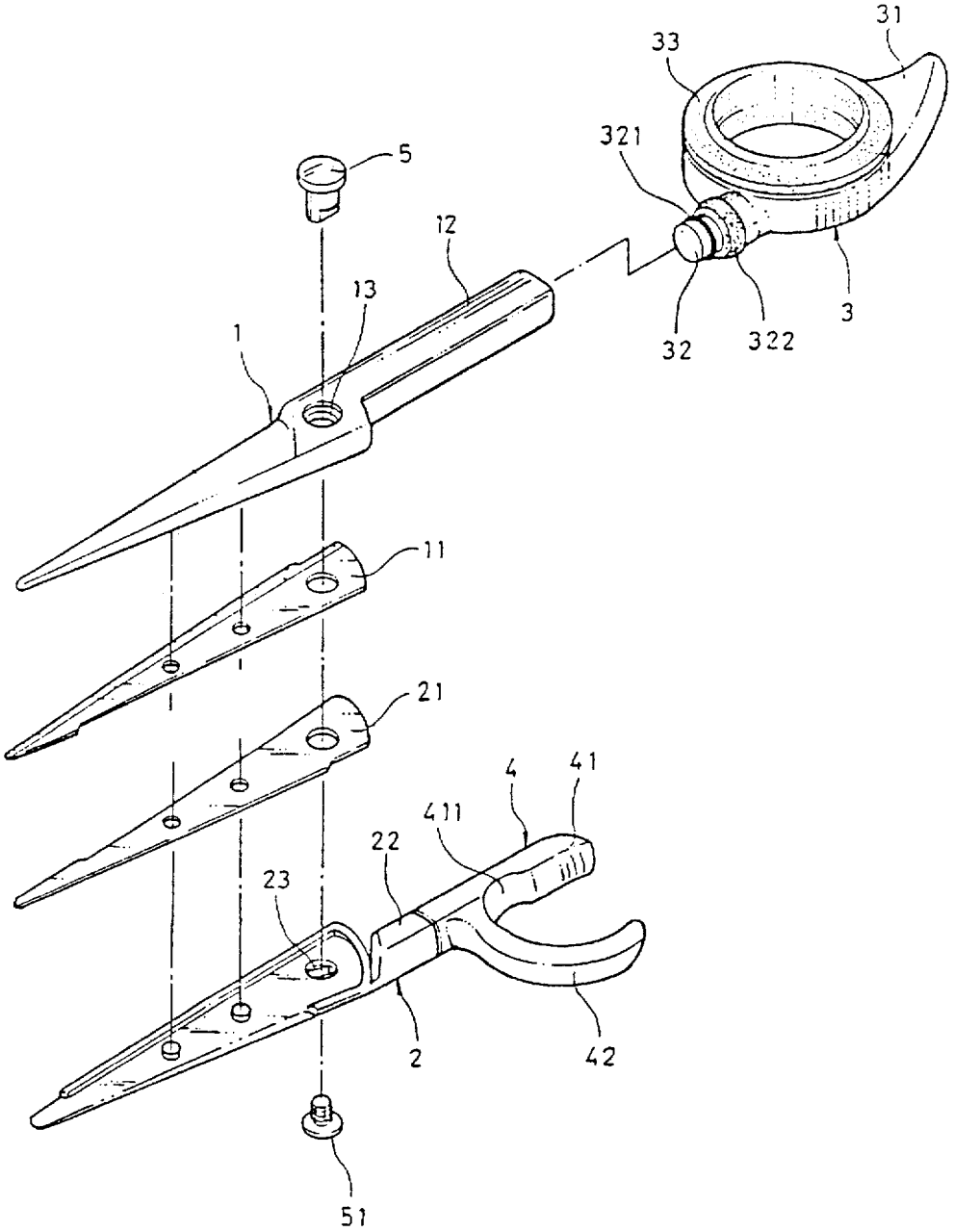
FIG. 2 is an exploded view of the thinning scissors shown in FIG. 1.
Figure 3:
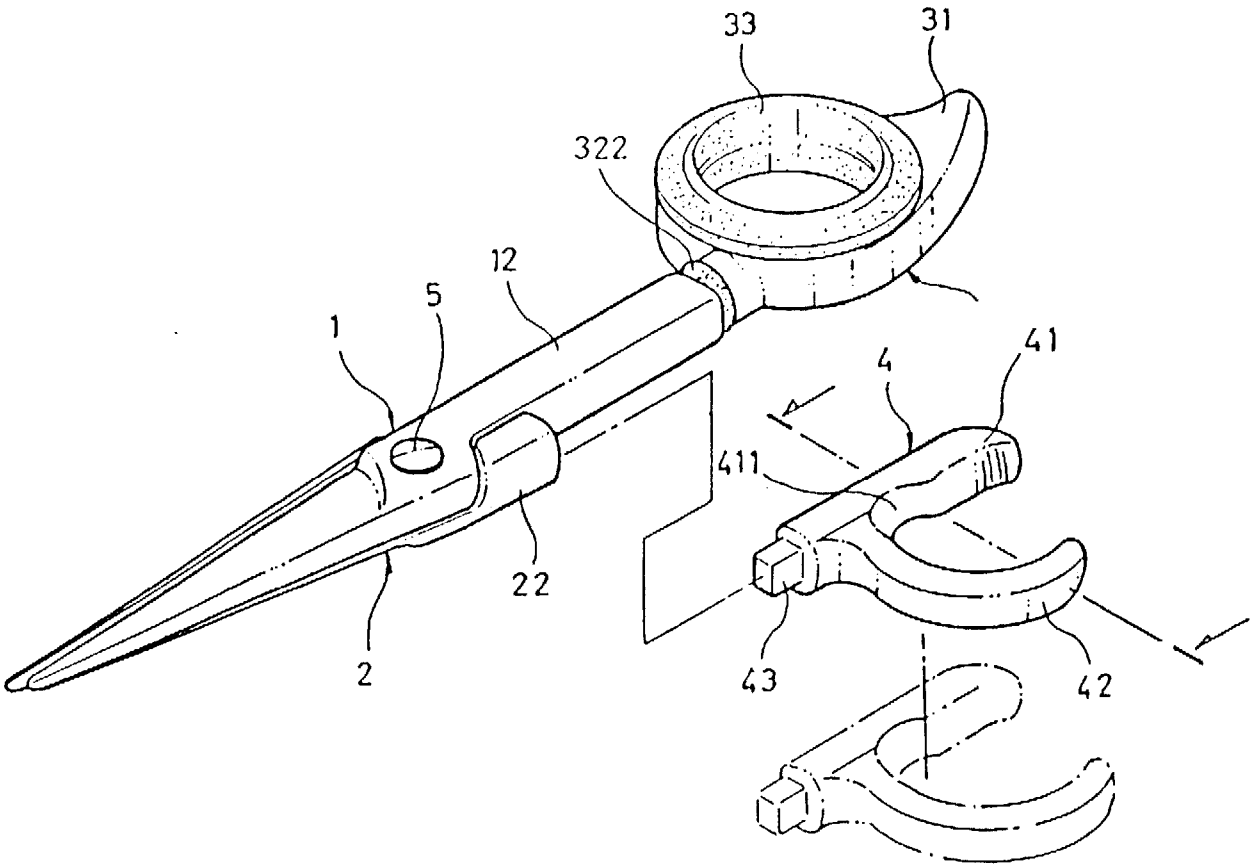
FIG. 3 is another exploded view of the thinning scissors shown in FIG. 1.

Referring to FIGS. 1, 2 and 3, a thinning scissors in accordance with the present invention generally comprises two blade holders 1, 2 pivoted together, and two cutting blades 11, 21 respectively fastened to the blade holders 1, 2. One blade holder, namely, the first blade holder 1 has a handle 12 at one end, a pivot hole 13 adjacent to the handle 12, and a finger ring 3 fastened to the end of the handle 12. The other blade holder, namely, the second blade holder 2 has a handle 22 at one end, a pivot hole 23 adjacent to the handle 22, and a fork member 4 fastened to the end of the handle 22. The pivot holes 13, 23 of the blade holders 1, 2 are pivotably connected together by a stud element 51 and a socket element 5. The finger ring 3 having a dovetail projection 31 raised from the periphery in one direction, and a projecting shaft 32 raised from the periphery in the reversed direction. The projecting shaft 32 has an annular coupling flange 321 raised around the periphery and inserted into a circular axial hole (not shown) on the handle 12 of the first blade holder 1. A first rubber ring 322 is mounted around the projecting shaft 32 between the handle 12 of the first blade holder 1 and the finger ring 3. A second rubber ring 33 is mounted within the finger ring 3 to fit the finger. When the finger ring 3 is coupled to the first blade holder 1, it can be turned in the circular axial hole of the handle 12 of the first blade holder 1.

The fork member 4 comprises an elongated rod 41 having a square coupling tip 43 at one end plugged into a square axial hole (not shown) on the handle 22 of the second blade holder 2, and a smoothly arched branch rod 42 raised from the elongated rod 41. A smoothly curved, recessed portion 411 is formed at the connecting area between the elongated rod 41 and the smoothly curved branch rod 42 at the inner side and adapted for the resting of the thumb.

Figure 4:
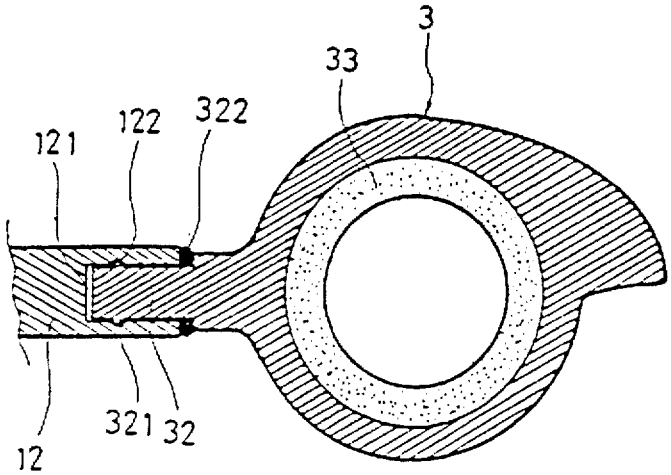
FIG. 4 is a sectional view in an enlarged scale of a part of the present invention, showing the connection between the finger ring and the handle of the first holder blade.

Referring to FIG. 4, the handle 12 of the first blade holder 1 has a circular axial hole 121, and an inside annular groove 122 around the periphery of the circular axial hole 121. When the projecting shaft 32 of the finger ring 3 is inserted into the circular axial hole 121 of the first blade holder 1, the annular coupling flange 321 of the projecting shaft 32 is forced into engagement with the inside annular groove 122 of the handle 12 to secure the finger ring 3 to the handle 12, enabling the finger ring 3 to be turned within the circular axial hole 121 of the handle 12.

Figure 5:
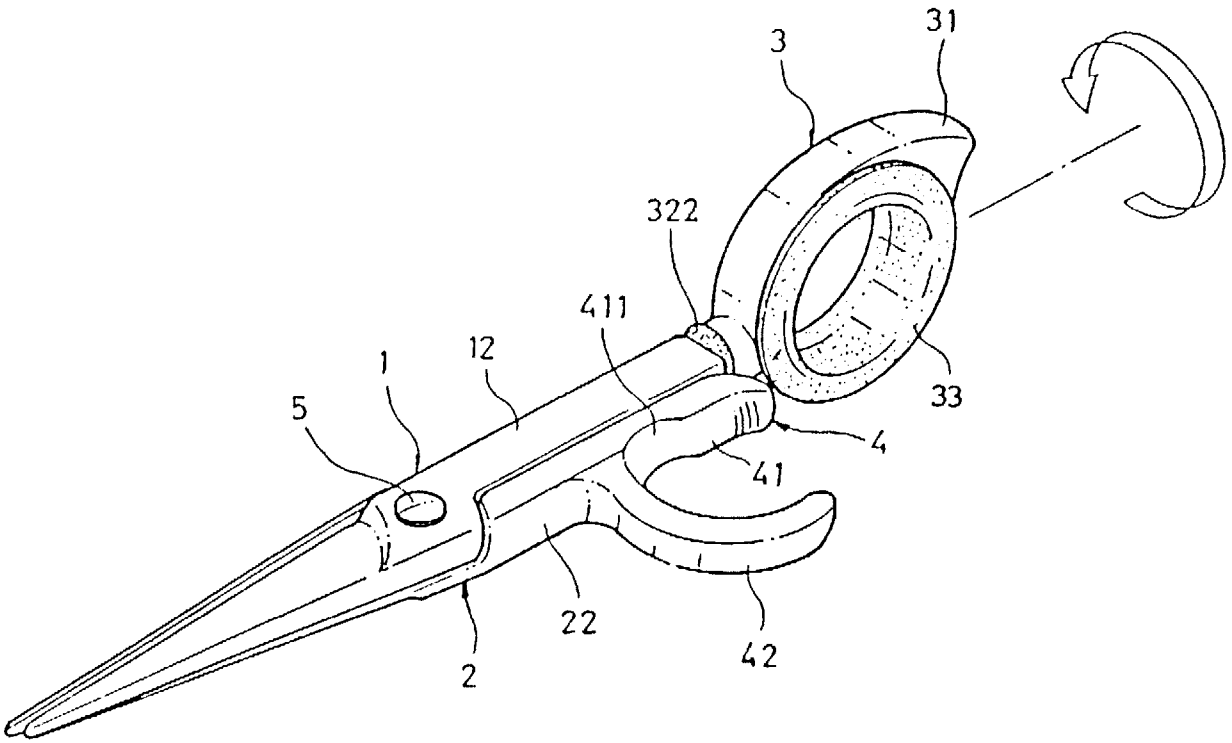
FIG. 5 shows the ring member turned relative to the first holder blade according to the present invention.

Referring to FIG. 5, the finger ring 3 can be turned about the longitudinal axis of the handle 12 of the first blade holder 1 to any angular position relative to the fork member 4. When to change the cutting angle in cutting the hair, the ring finger is maintained in the second rubber ring 33, the fork member 4 is forced by the thumb to move the second blade holder 2, and therefore the finger ring 3 is forced by a reaction force to change its angular position relative to the handle 12 of the first blade holder 1.

Figure 6:
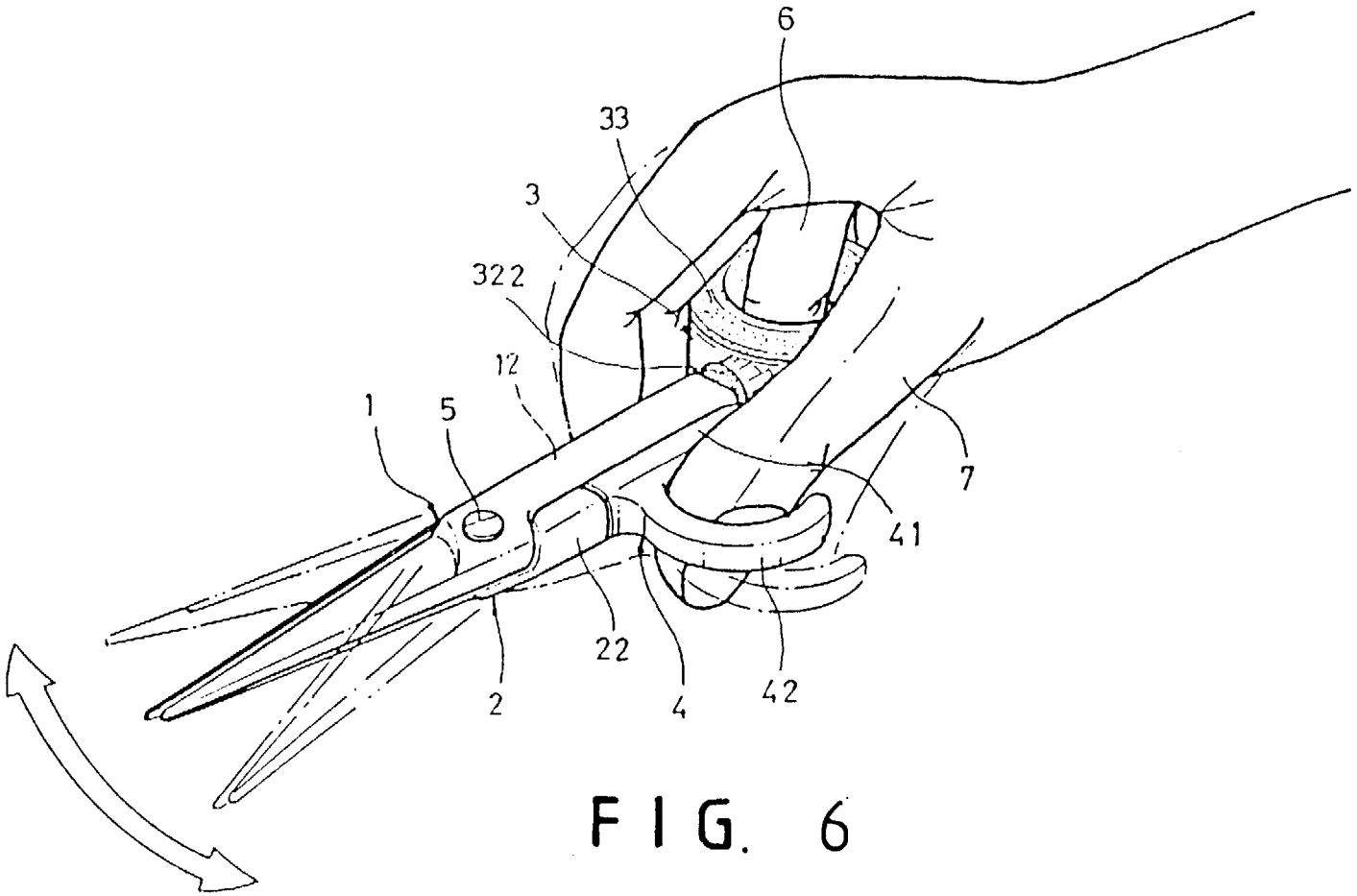
FIG. 6 is an applied view of the present invention, showing the thinning scissors operated.

Referring to FIG. 6 and FIG. 1 again, when in use, the ring finger 6 is inserted into the second rubber ring 33 of the finger ring 3, the thumb 7 is attached to the fork member 4 with the finger cushion stopped at the recessed portion 411. By moving the ring finger 6 and the thumb 7 relative to each other, the blade holders 1;2 are forced to act against each other, and the cutting blades 11;21 are forced to cut the hair when the blade holders 1;2 come together. By turning the thumb 7, the angular position of the finger ring 3 is relatively changed. Because the second rubber ring 33 is replaceable, it can be changed to fit the user's ring finger. Further, because the thumb 7 is attached to the fork member 4, the thinning scissors can be conveniently released from the hand.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A pair of thinning scissors comprising:

a first blade holder and a second blade holder pivoted together, said first blade holder having handle extended from a rear end thereof and defining a circular axial hole, said second blade holder having a handle extended from a rear end thereof and defining a square axial hole;

a first cutting blade and a second cutting blade respectively fastened to said first blade holder and said second blade holder and moved against each other for cutting hair;

a finger ring mounted with a rubber ring on the inside surface thereof and attached to the handle of said first blade holder for receiving a user's ring finger, said finger ring having a projecting shaft raised from the periphery of the finger ring and turnably received in the circular axial hole of the handle of said first blade holder; and a fork member attached to the handle of said second blade holder for moving said second blade holder relative to said first blade holder by the user's thumb, said fork member having a square coupling tip fitted into the square axial hole of the handle of said second blade holder.

2. The thinning scissors as claimed in claim 1, wherein the handle of said first blade holder comprises an inside annular groove around the periphery of the circular axial hole thereof; the projecting shaft of said finger ring comprises an annular coupling flange forced into engagement with the inside annular groove of the handle of said first blade holder.

3. The thinning scissors as claimed in claim 1, wherein the rubber ring of said finger ring is detachable.

4. The thinning scissors as claimed in claim 1, wherein said fork member comprises an elongated rod, a smoothly arched branch rod raised from said elongated rod, and a smoothly curved, recessed portion formed between said elongated rod and said smoothly curved branch rod at an inner side and adapted for supporting the user's thumb.

* * * * *